US007942689B1

(12) United States Patent
Huss, Jr. et al.

(10) Patent No.: US 7,942,689 B1
(45) Date of Patent: May 17, 2011

(54) ELECTRICAL CONNECTOR ASSEMBLY AND METHOD

(75) Inventors: John Phillip Huss, Jr., Harrisburg, PA (US); Ralf Geske, Schieder-Schwalenberg (DE); Hans-Hilmar Schulte, Schieder-Schwalenberg (DE); Karsten Freund, Holzen (DE); Markus Sonderer, Hoxter (DE); Thomas Beier, Schloss Holte (DE)

(73) Assignee: Phoenix Contact Development & Manufacturing, Inc., Middletown, PA (US)

( * ) Notice: Subject to any disclaimer, the term of this patent is extended or adjusted under 35 U.S.C. 154(b) by 0 days.

(21) Appl. No.: 12/957,500

(22) Filed: Dec. 1, 2010

Related U.S. Application Data

(63) Continuation of application No. 12/715,637, filed on Mar. 2, 2010, now Pat. No. 7,845,968.

(51) Int. Cl.
*H01R 4/24* (2006.01)

(52) U.S. Cl. ..... 439/409

(58) Field of Classification Search ..... 439/395–418
See application file for complete search history.

(56) References Cited

U.S. PATENT DOCUMENTS

| | | | |
|---|---|---|---|
| 2,769,154 | A | 10/1956 | Greenbaum |
| 3,835,445 | A | 9/1974 | Hardesty |
| 4,874,329 | A | 10/1989 | Yu |
| 5,762,518 | A | 6/1998 | Tanigawa et al. |
| 5,785,548 | A | 7/1998 | Capper et al. |
| 6,152,760 | A | 11/2000 | Reeser |
| 6,254,421 | B1 | 7/2001 | Denovich et al. |
| 6,409,544 | B1 | 6/2002 | Wu |
| 6,579,115 | B2 | 6/2003 | Mitsugi |
| 7,347,716 | B2 | 3/2008 | Oesterhaus et al. |
| 7,442,070 | B2 | 10/2008 | Lee |
| 7,462,060 | B2 | 12/2008 | Hamoignon |

OTHER PUBLICATIONS

TYCO Electronics, Industrial Ethernet IP20 Field Installable RJ45 Modular Plug, 4 pages, Feb. 2008.

*Primary Examiner* — Khiem Nguyen
(74) *Attorney, Agent, or Firm* — Hooker & Habib, P.C.

(57) ABSTRACT

An electrical connector assembly for forming insulation displacement connections with conductors in small wires includes a wire carrier and a base. Pierce points on the base are slid along opposed walls in a slot in the carrier to align small tips on the ends of the pierce points to form electrical connections with a conductor in a wire in the carrier. The connections are located inwardly of the slot walls.

20 Claims, 15 Drawing Sheets

ELECTRICAL CONNECTOR ASSEMBLY AND METHOD

FIELD OF THE INVENTION

The invention relates to electrical connector assemblies for forming insulation displacement connections with insulated wires and to related methods.

DESCRIPTION OF THE PRIOR ART

Contact members are individually attached to the ends of small diameter wires in the field using special tooling to strip the insulation from the end of the wire and then crimp part of a contact member around the exposed conductor. After the contact member is crimped to the wire, the member is placed in an assembly to position the member for establishing an electrical connection with a mating part. The two-step procedure is cumbersome, complex and inconvenient.

Sometimes, special tooling is used to strip insulation from a number of wires simultaneously and then simultaneously crimp contact members onto the stripped ends of the wires. In some cases different diameter wires must be attached to contacts at the same time. Specialized tooling is required.

Insulation displacement connections have been used to form connections with wires. However, a disadvantage of insulation displacement connections for small wires in conventional electrical connector assemblies is the inability of accurately locating the insulation displacement contact point with the conductor in the wire during closing of the assembly when a number of connections are established at the same time. This alignment problem arises because of accumulated molding tolerances in the parts of the connector which support the wires and the insulation displacement contact members.

SUMMARY OF THE INVENTION

The invention is an improved electrical connector assembly and method for forming insulation displacement connections with small diameter wires in field locations. The assembly includes a base and one or more wire carriers. Two small insulated wires are inserted into each wire carrier when the carriers are in an open position. The wire carriers are then manually moved into the base one at a time to form insulation displacement connections between the conductors in the wires and metal contact members in the base. The connection between each wire carrier and the base as the parts are moved together assures that the conductor in each wire is located above an insulation displacement contact member when the carriers are moved down to the contact position and pierce points on the contact member penetrates the conductors to form electrical connections.

The use of wire carriers each holding two wires prevents the build up tolerances between the contact members and the wire passages holding the wires and assures that the insulation displacement contact members reliably engage the conductors in the wires held in the passages.

The wire carrier used in the connector assembly has specialized wire passages which receive and orient wires of different diameters so that when the wire carriers are moved into the base, the insulation displacement contact points pierce the wires and engage the conductors in the wires to form electrical connections.

The electrical connector assembly is very compact, allowing close spacing of the insulation displacement contact members in the base and close spacing of the wire passages in the carriers. This reduces the real estate required for mounting the assembly on a circuit board or other member and reduces manufacturing cost.

The assembly may have one or more wire carriers. The wire carriers can be identical. This reduces manufacturing cost for the assembly. Alternatively, the assembly may have two or more wire carriers which receive a different number of wires for forming electrical connections. For instance, the assembly may have one two-wire carrier and one three-wire carrier. The wire carriers can receive different diameter wires. Each carrier can be closed manually, without the necessity of using a closing tool.

The wire carrier can be rotated or translated into the base. When rotated into the base, the carrier moves along a cam which moves the carrier forward against a latch to flex the latch and, when the wire carrier is fully rotated into the base, to position the carrier against the latch to increase the overlap between the latch and the carrier and strengthen the latched connection holding the carrier in the base.

The insulation displacement contacts used in the electrical connector assembly are formed from a strip of thin metal and have three upwardly extending pierce points. The tips of two of the pierce points are located on opposite sides of the strip and, during closing of the assembly, slide along the opposite walls of a contact slot in the carrier to engage the conductor of the wire located in a wire passage above the slot. The third pierce point has a tip located midway between the sides of the strip. The three laterally spaced tips increases the likelihood that the tips will engage the stranded conductor in the wire to form an electrical connection with the conductor.

The three pierce points have a thickness at the base of the pierce points equal to the thickness of the strip and a reduced thickness along the height of the points to the tips. The tips are inserted into the stranded conductor in the wire and, with further insertion, spread the conductors apart to increase the normal forces between the tip and the strands of wire. The wires are confined in the wire passage. The increased normal forces between the sides and edges of the tips and the strands in the conductor improves electrical connections with the conductor.

DESCRIPTION OF THE PREFERRED EMBODIMENTS

Figure 1:
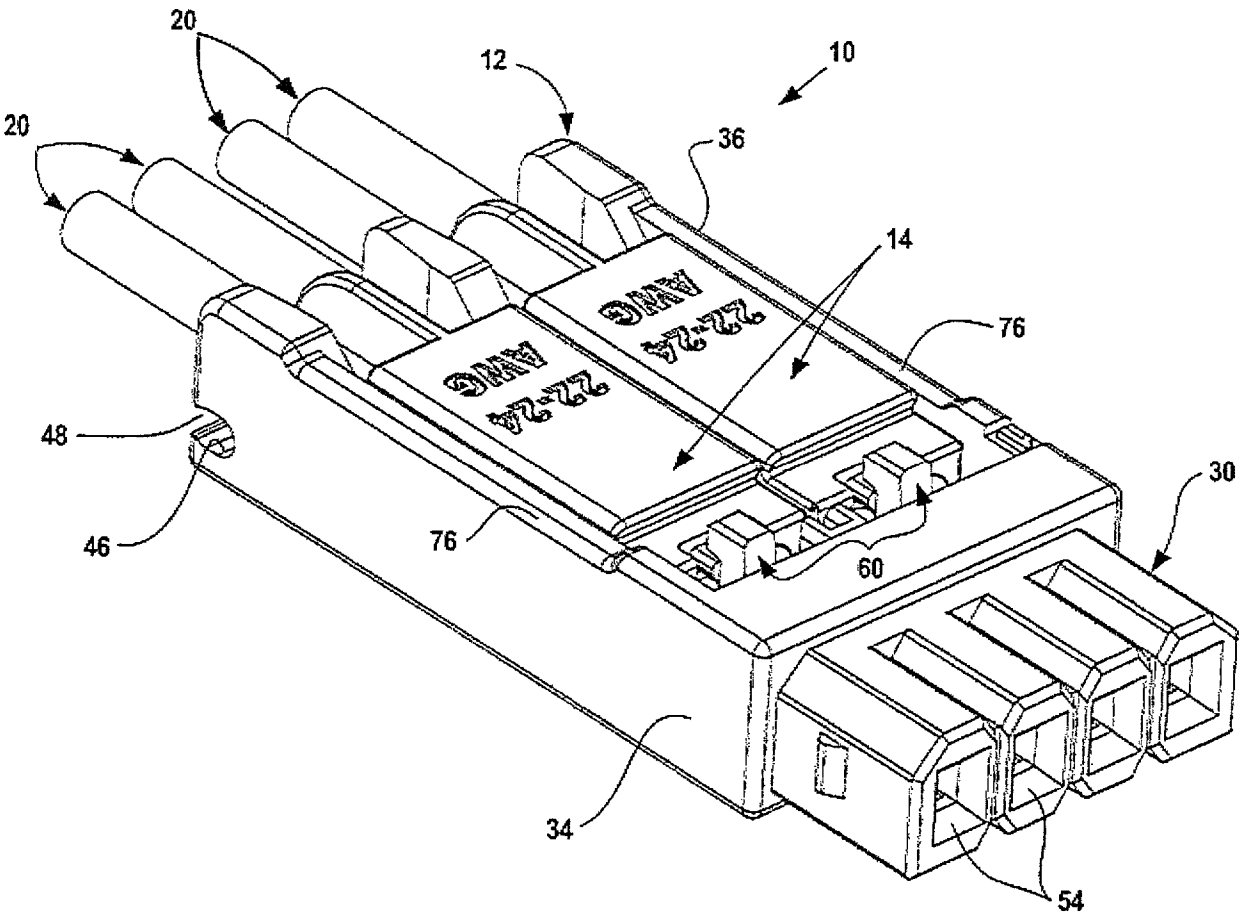
FIG. 1 is a front perspective view of an electrical connector assembly according to the invention.

First embodiment electrical connector assembly 10 is illustrated in FIGS. 1-20 of the drawings. Assembly 10 includes a molded plastic base 12 and two molded plastic wire carriers 14 pivotally mounted on the rear end of the base at hinge connections 16. Four metal contact members 18 are mounted in base 12 for forming redundant insulation displacement electrical connections with wires 20 inserted in carriers 14. Two wires are inserted into each wire carrier.

Figure 14:
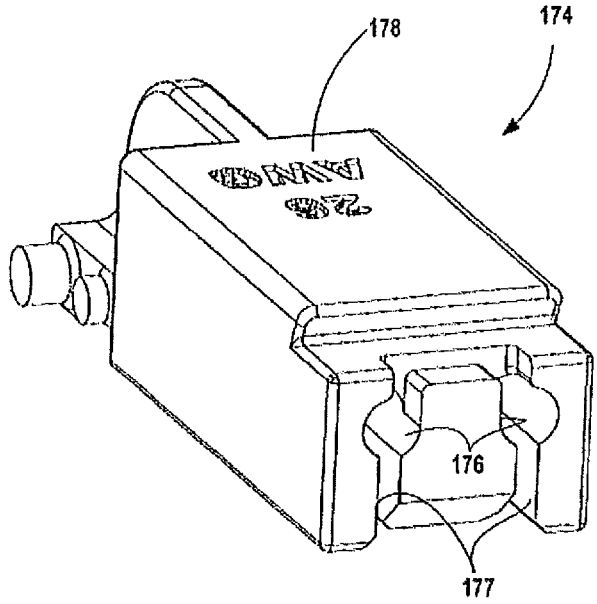
FIG. 14 is a front perspective view of a wire carrier for small diameter wires.
Figure 15:
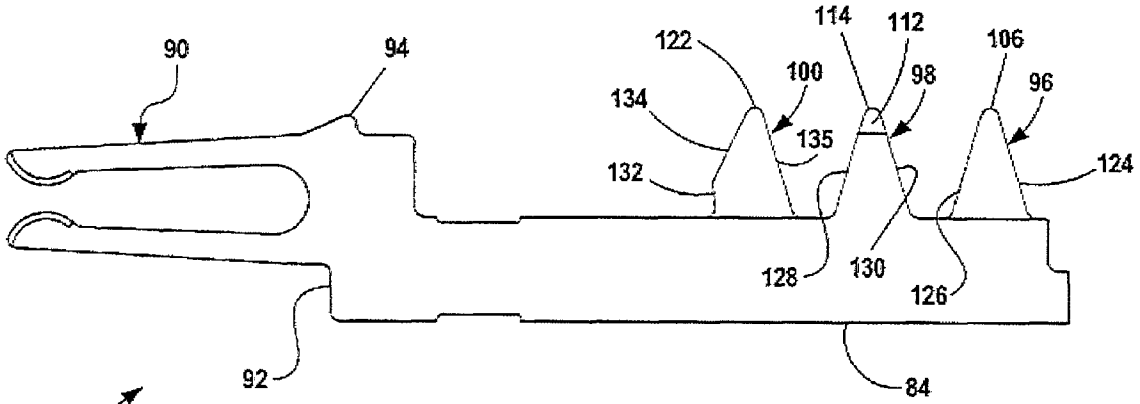
FIGS. 15 and 16 are opposed side views of a contact member used in the assembly.
Figure 16:
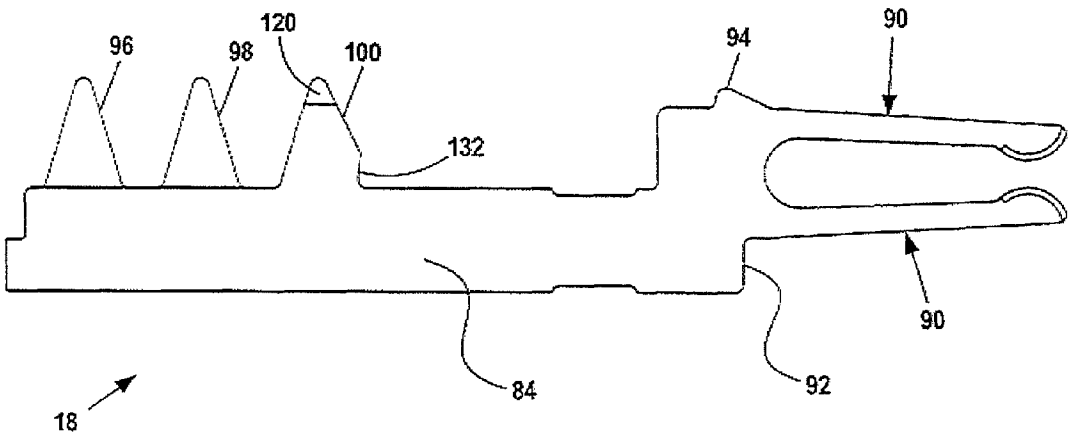

Wires 20 typically have small diameters and small central stranded metal conductors 22 surrounded by an insulating sheath 24, which may be made of PVC. The electrical connector assembly 10 shown in FIG. 1 forms reliable electrical connections with AWG 22 or AWG 24 wires 20. FIG. 14 illustrates an alternative wire carrier 174 for making connections with AWG 26 wires.

AWG 22-26 wires are very small. AWG 22 wire has a diameter of 1.6 mm and a stranded conductor having a diameter of 0.65 mm. AWG 24 wire has a diameter of 1.4 mm and a stranded conductor having a diameter of 0.51 mm. AWG 26 wire has a diameter of 1.0 mm and a stranded conductor having a diameter of 0.40 mm. The compact assembly 10 forms reliable, redundant insulation displacement connections with conductors in these small wires.

Base 12 has a flat bottom wall 28, a contact housing 30 extending across the front of the bottom wall 28, and a rear edge 32 extending across the rear of the bottom wall opposite from housing 30. Vertical side walls 34 and 36 extend above the sides of the bottom wall 28 between housing 30 and edge 32. Walls 34 and 36 include rear extensions 38 and 40 extending rearwardly of edge 32. The base includes a central extension 42 between extensions 38 and 40. The extensions form hinge connections with the wire carriers. The rear portion of each wire carrier 14 is located between the central extension 42 and one of the side extensions 38 and 40.

Side walls 34 and 36 and housing 30 extend above bottom wall 28 to form a central recess 44 for receiving the two wire carriers 14. The rear side of recess 42 is open between extensions 40 and 42 and 38 and 42 to accommodate the wire carriers 14 and wires extending from the carriers. The hinge connections 16 in extensions 38, 40 and 42 include open, rearwardly facing post-receiving slots 46 extending into the extensions. The narrowed mouth 48 of each slot has a reduced width for snap-in engagement with a pivot post on a wire carrier 14, as will be described below.

Contact housing 30 includes four contact chambers 50 spaced across the front of base 12. Each chamber 50 opens into central recess 44 through a rear opening 52 and includes a front facing opening 54 for receiving an elongate contact pin or blade. A longitudinal slot 56 is formed in bottom wall 28 in alignment with each chamber 50 and extends from the chamber to rear edge 32. The forward end 58 of slot 56 extends into chamber 50. See FIG. 7.

Figure 2:
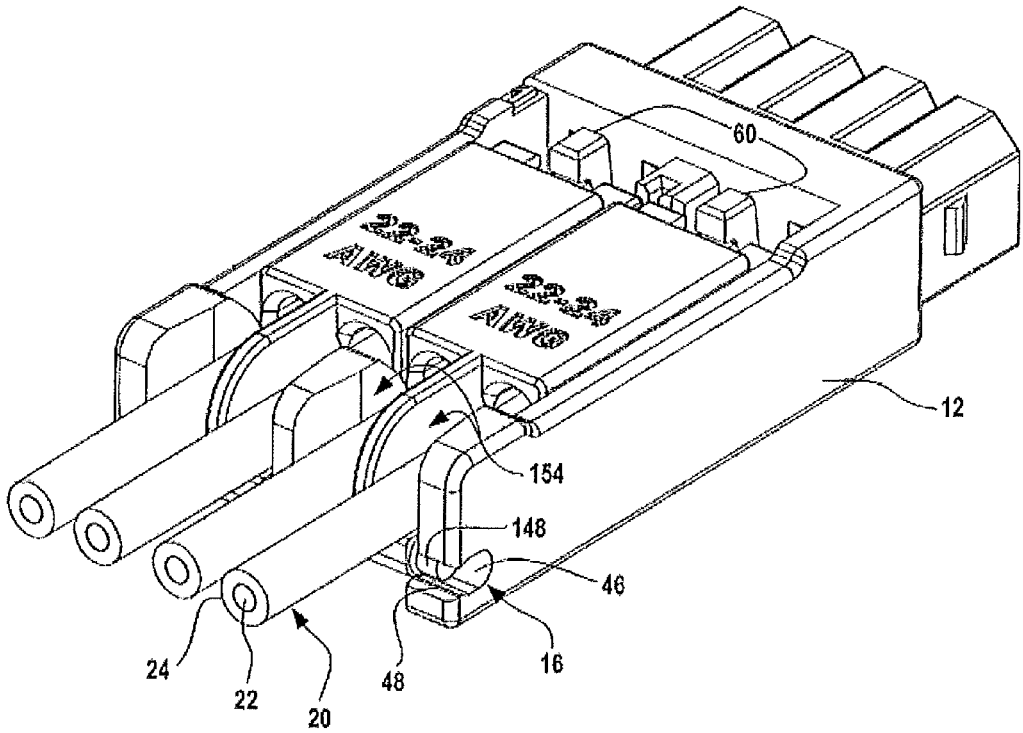
FIG. 2 is a rear perspective view of the assembly shown in FIG. 1.

Two integral latches 60 extend upwardly from the front of bottom wall 28 adjacent to front housing 30. Each latch 60 is located between a pair of slots 56 and includes an upwardly extending, stiffly flexible arm 62 and rearwardly facing latch member 64 on the top of the arm. Each of the latches 60 holds a wire carrier 14 in recess 44 when the carrier is rotated to the contact position in recess 44 as shown in FIGS. 1, 2 and 3.

Shield alignment member 66 extends rearwardly from housing 30 between latches 60 and includes a rearwardly facing vertical slot 68. Slot 68 opposes forwardly facing slot 70 in central extension 42 at the rear of base 12.

Assembly 10 may be provided with a metal EMI shield. The shield includes a metal plate (not illustrated) fitted between carriers 14 in the contact position with ends extending into slots 68 and 70. A circumferential metal shield in electrical connection with the plate (not illustrated) may extend around the carriers and base.

Figure 3:
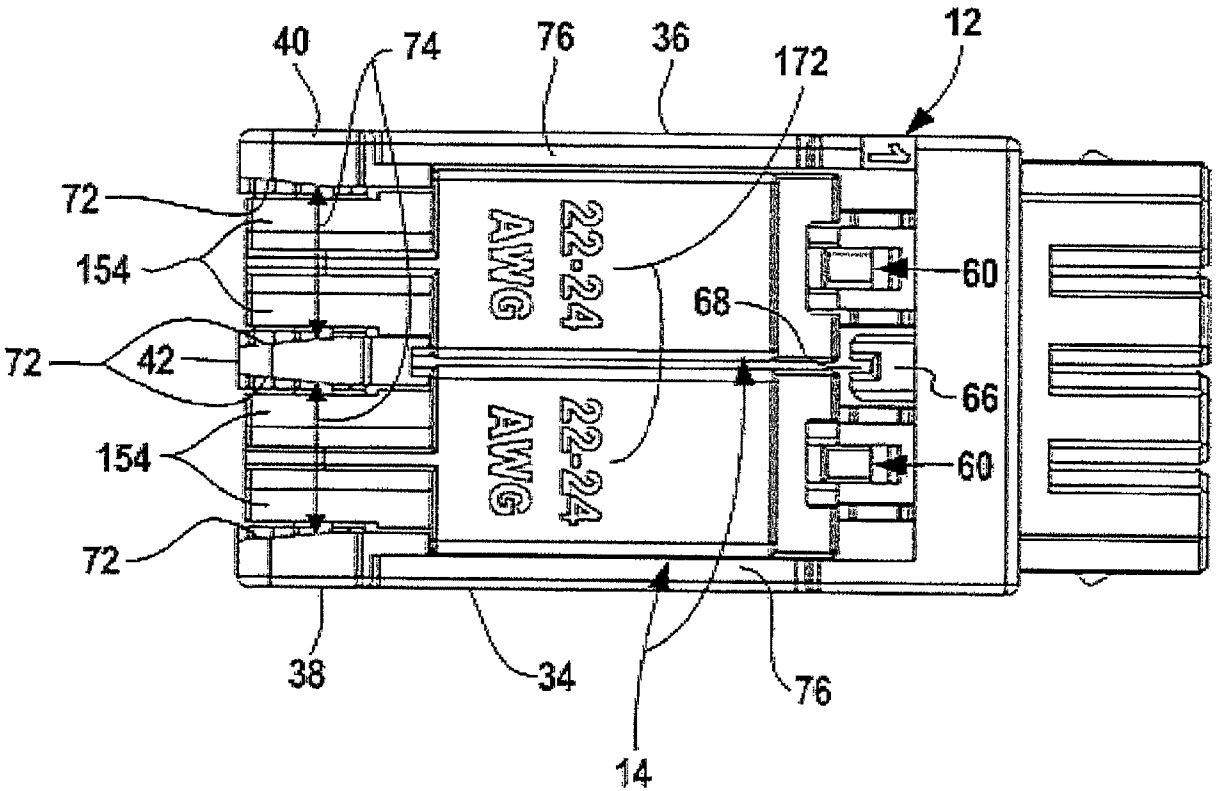
FIG. 3 is a top view of the assembly, with wires removed.

As illustrated in FIG. 3, the interior sides 72 of extensions 38, 40 and 42 are tapered inwardly away from the rear of base 12 to decrease the width of recesses 74 between the extensions. The forward faces of extensions 38, 40 and 42 each include an upper rounded cam surface 78 and a lower vertical support surface 80 adjacent bottom wall 28.

The interior side of each extension 38, 40 and 42 has a side cavity 74 extending up from the base to top edge 84 at tapered wall 72. See FIG. 4. Cavity top edges 84 limit upward rotation of the wire carriers mounted on the base. The base side walls 34 have reduced heights at recesses 76.

Metal contact members 18 mounted in base 12 are illustrated in FIGS. 15-20. Each contact member 18 is formed from flat, uniform thickness metal stock which may be beryllium copper, phosphor bronze or other suitable metal. Each contact member 18 includes a flat, uniform thickness mounting portion or strip 84 having parallel sides 86 and 88. The strip may have a thickness of 0.4 mm.

A contact element 90, which may be tuning fork contacts as illustrated, extends from the front end of strip 84. The elements 90 are located a distance above the strip to form an alignment stop 92 at the front end of member 18. A retention barb 94 extends upwardly from contact 90 for retaining member 18 in base 12 as described below. Three pierce points 96, 98 and 100 are spaced along and extend above strip 84. The pierce points are generally triangular in shape with inwardly tapered edges extending above strip 84.

Figure 17:
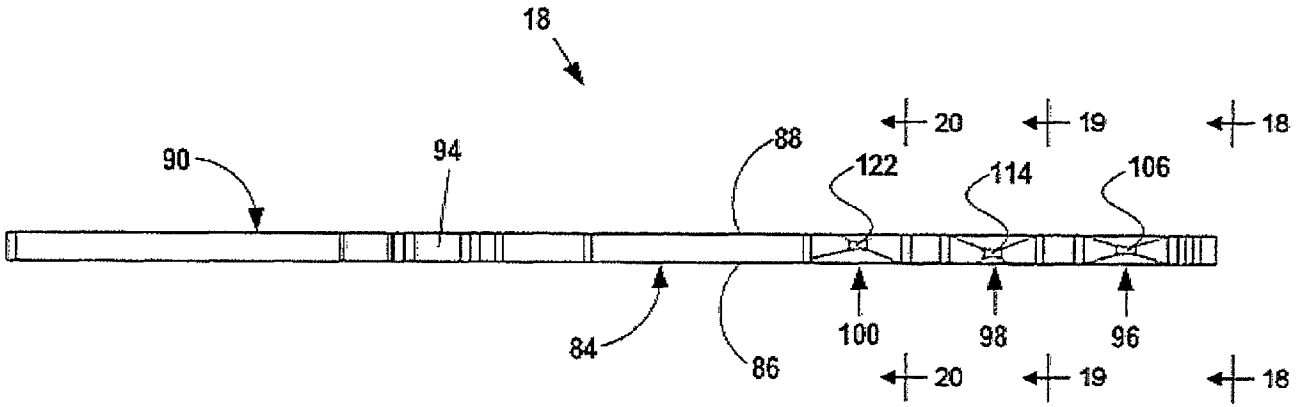
FIG. 17 is a top view of the contact member.
Figure 20:
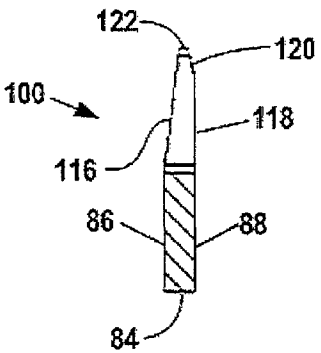
FIGS. 18, 19 and 20 are sectional views taken respectively along lines 18-18, 19-19 and 20-20 in FIG. 17.
Figure 19:
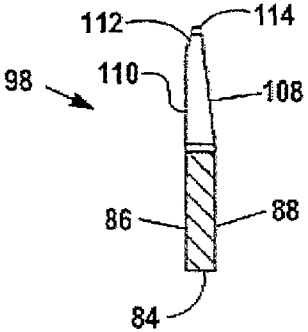
Figure 18:
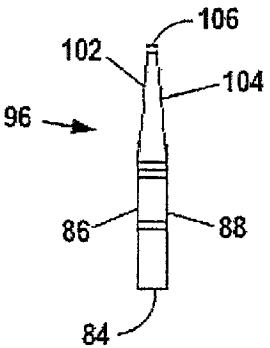

Triangular rear pierce point 96 has inwardly tapered sides 102 and 104 extending above strip sides 86 and 88. Sides 102 and 104 join at small tip 106 located at the top of pierce point 96. As illustrated in FIGS. 17 and 18, tip 106 is located above the center of strip 84 and equidistant between strip sides 86 and 88.

Triangular pierce point 98 has an inwardly tapered side 108 extending inwardly from strip side 88 to the top of the point. Point 98 also includes a vertical alignment side 110 forming an extension of strip side 86 and extending upwardly to intersection with short, inwardly tapered surface 112 a short distance below pierce point tip 114. Tip 114 is located at the top of the point. Tip 114 is located above strip 84. The tip 114 is spaced a short distance inwardly from coplanar sides 86 and 110 by tapered surface 112 and is adjacent to strip side 86 and away from strip side 88. See FIGS. 17 and 19.

Pierce point 100 has an inwardly tapered side 116 extending inwardly above strip side 86 to the top of the point. Point 100 also includes a vertical alignment side 118 forming an extension of strip side 88 and extending upwardly to intersection with short, inwardly tapered surface 120 a short distance below pierce point tip 122. Tip 122 is located at the top of the point. Tip 122 is located above strip 84. The tip 122 is spaced a short distance inwardly from coplanar sides 88 and 118 by tapered surface 120 and is adjacent to strip side 88 and away from strip side 86.

Rear pierce point 96 has tapered, straight and inwardly angled front and rear edges 124 and 126 extending up from the top of strip 84 to tip 106. Central pierce point 98 has tapered, straight and inwardly angled front and rear edges 128 and 130 extending from the top of strip 84 to tip 114. The front pierce point 100 has a front edge including a forwardly angled wire retention surface 132 extending a short distance above the top of strip 84 and a tapered, straight and inwardly angled edge 134 extending from the top of retention surface 132 to the tip 122 for the point. Point 100 also includes a tapered, straight forwardly angled rear edge 135 extending from the strip 84 to tip 122.

The forward angled retention edge 132 forms a lock to prevent withdrawal of a wire from assembly 10 after the wire carrier has been rotated to the closed contact position to form insulation displacement electrical connections with the wires. FIG. 17 illustrates that tip 106 is located centrally between strip sides 86 and 88, tip 114 is located adjacent strip side 86 and tip 122 is located adjacent strip side 88.

Figure 7:
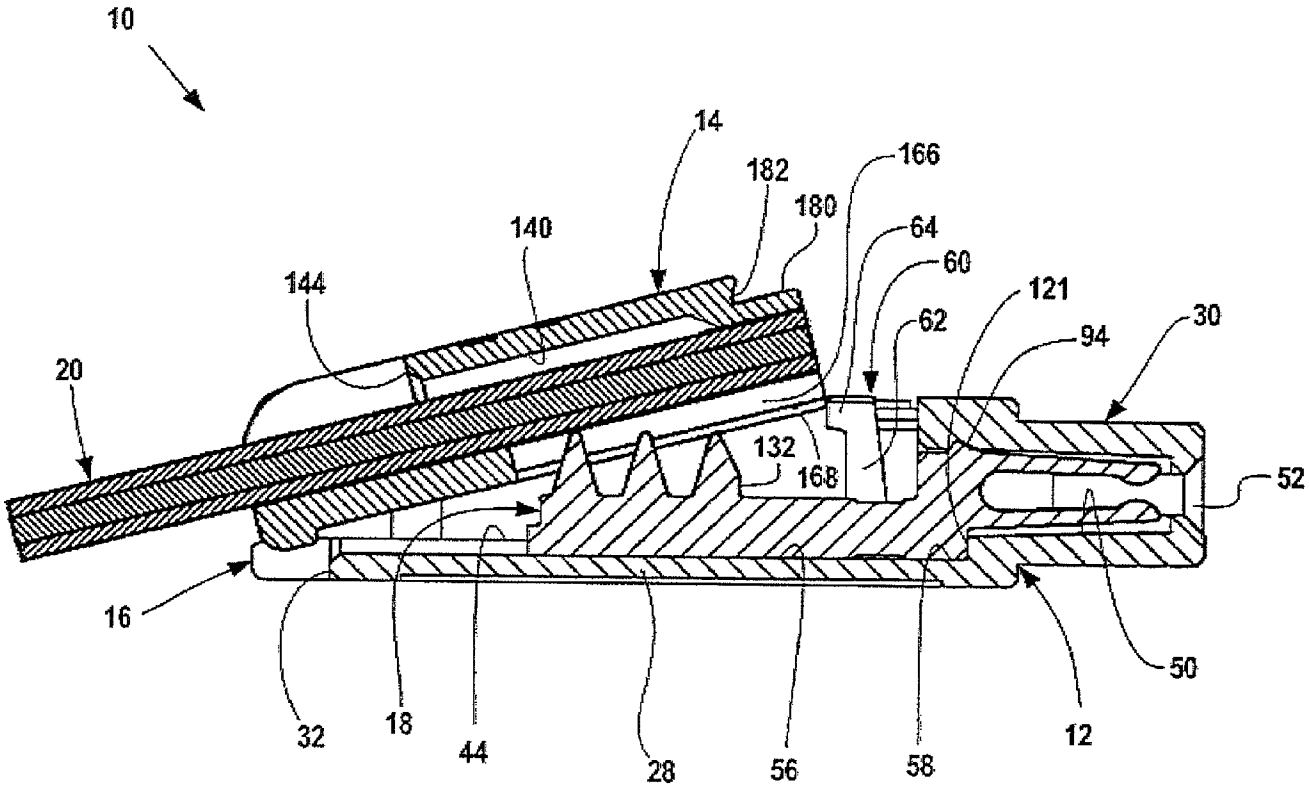
FIG. 7 is a vertical sectional view through the assembly with the wire carrier in the wire insertion position and a wire inserted into the carrier, prior to closing the assembly and forming electrical connections between the wire and the contact member.

In electrical connector assembly 10, four metal contact members 18 are mounted in base 12 before the wire carriers 14 are pivotally connected to the base. Each contact member 18 is positioned vertically above a slot 56 with the lead contact element 90 above and slightly behind the forward end of recess 44. The contact members are then moved vertically downwardly to fit the bottoms of strips 84 in slots 56. Once the strips are in the slots, the contact members are moved forwardly to extend contact elements 90 into the contact chambers 50 aligned with the slots until stop surfaces 92 abut wall 121 at the rear end of chambers 50. With the contact members in place as shown in FIG. 7, retention barbs 94 engage the top walls of chambers 50 to retain the contact members in the base.

Each wire carrier 14 includes a molded dielectric body 138 having two longitudinally extending, laterally spaced wire passages 140 extending from body front wall 142 to body rear wall 144. Flat support member 146 extends rearwardly from the bottom of rear wall 144. Support member 146 is narrower than body 138. Opposed hinge posts 148 extend from opposite sides of the end of support member 146. Rotation limiting posts 150 extend from the sides of support member 146 between posts 148 and body end 144. Posts 150 are shorter than posts 148 and are a short distance above posts 148.

Vertical support member 152 joins the rear wall 144 of body 138 and the top of member 146 to support member 146. Carriers 14 are mounted in base 12 to define four individual wire alignment spaces 154 between the members 152 and adjacent extensions 38, 40 and 42.

Figure 9:
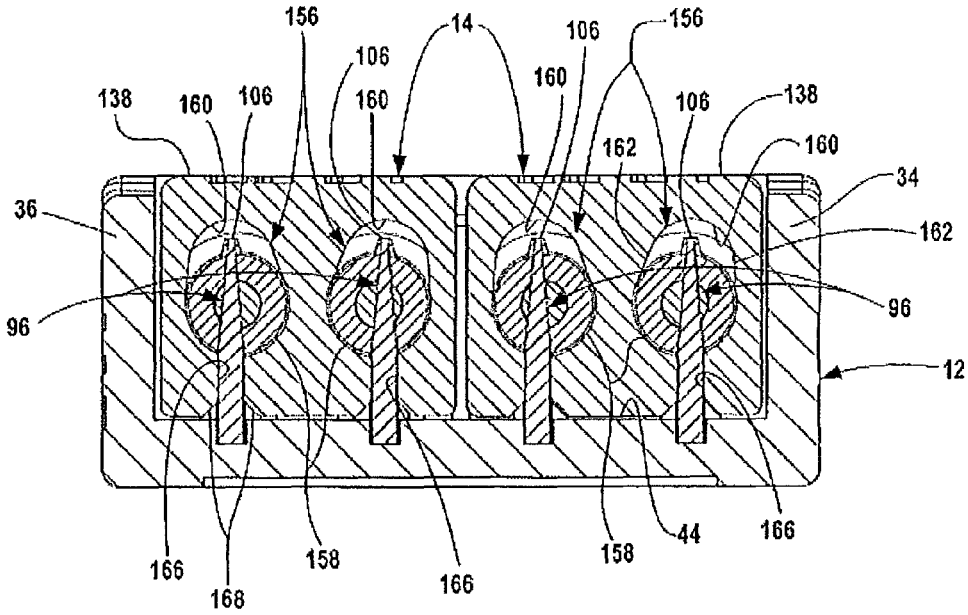
FIGS. 9, 10 and 11 are vertical sectional views taken along lines 9-9, 10-10 and 11-11 of FIG. 8 respectively.
Figure 10:
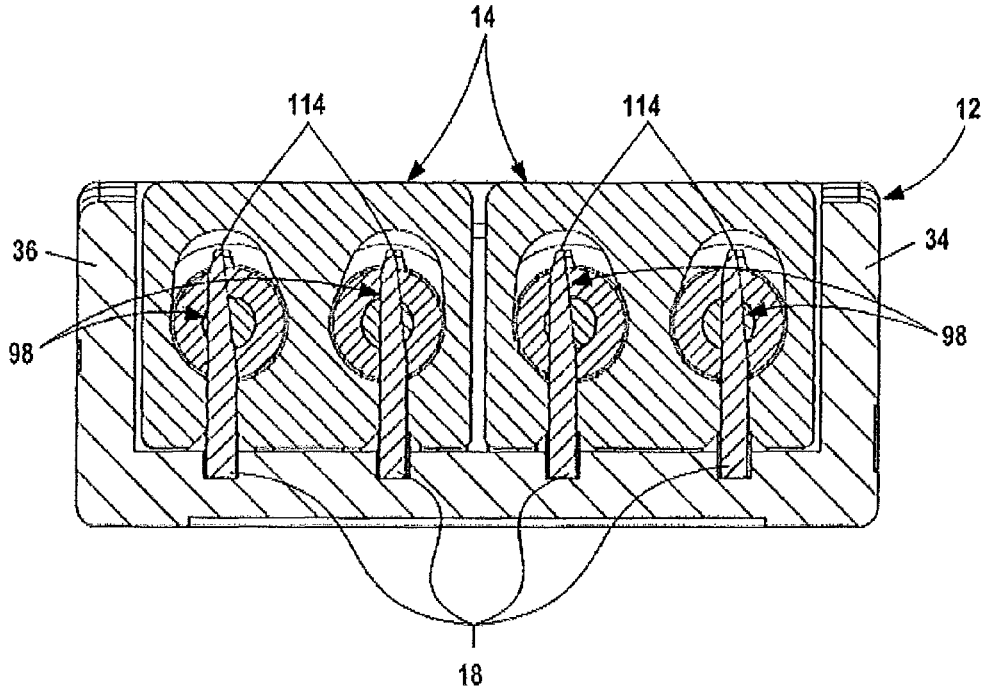
Figure 11:
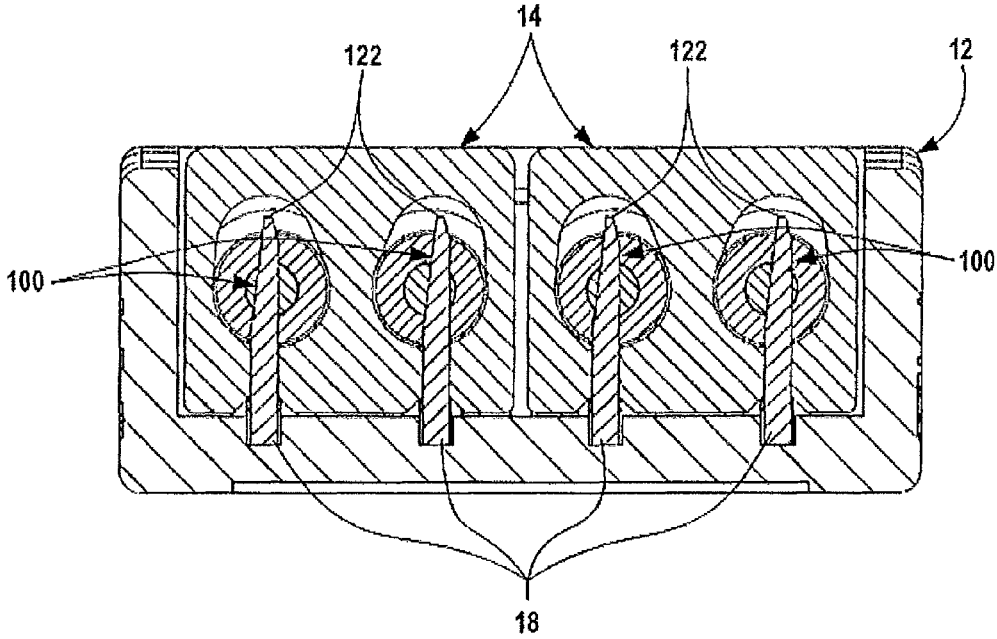
Figure 12:
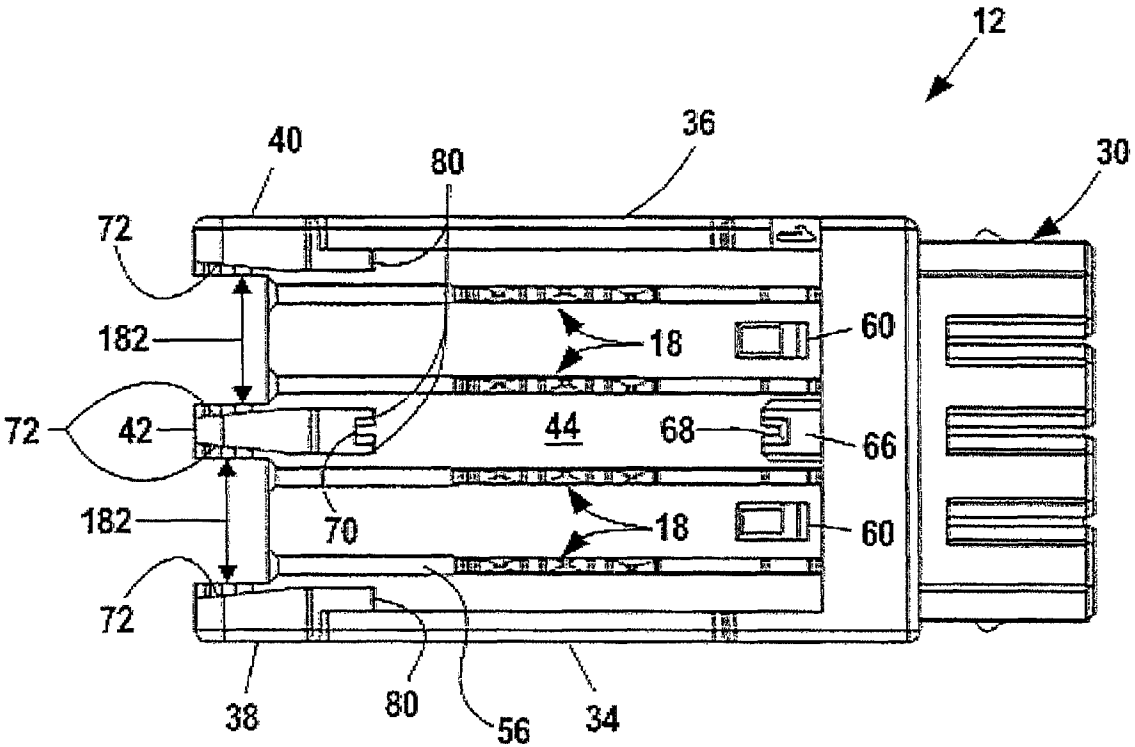
FIG. 12 is a top view of the connector assembly base with the wire carriers removed.
Figure 13:
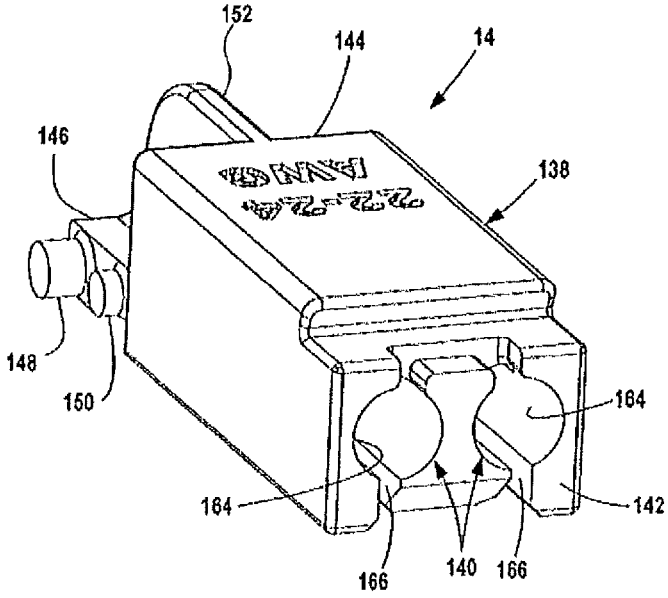
FIG. 13 is a front perspective view of a wire carrier for large diameter wires.

The rear portions 156 of wire passages 140 extend into body 138 from rear wall 144. Portions 156 have a non-cylindrical cross section as illustrated in FIGS. 9, 10 and 11. Each passage portion 156 has a lower partial cylindrical portion 158 for receiving AWG 22 insulated wire and an upper partial cylindrical portion 160, smaller in diameter than portion 158, for receiving smaller diameter AWG 24 insulated wire. Straight chordal walls 162 join portions 158 and 160. The upper smaller diameter cylindrical portions 160 are located above the contact members 18 in base 12. The lower partial cylindrical larger diameter portions 158 are also located above members 18 but are slightly offset inwardly of the contact members. The lower portions 158 are offset with regard to the contact members in order to maintain adequate wall thickness in body 138 between the lower portions 158 and the adjacent sides of body 138.

Figure 8:
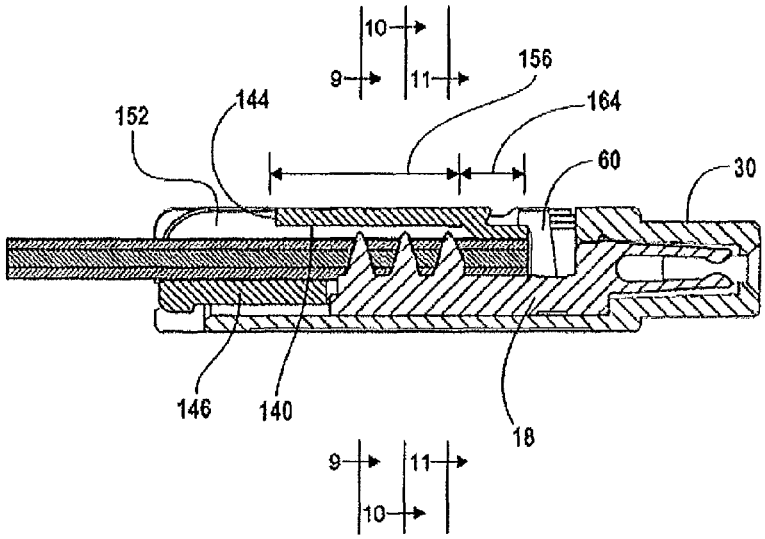
FIG. 8 is a view like FIG. 7 after the assembly has been closed and electrical connections are formed.

The rear portions 156 of passages 140 extend from rear wall 144 a distance beyond the pierce points as shown in FIG. 8. The forward portions 164 of passages 140 are cylindrical and have a diameter to receive large diameter AWG 22 wire. The portions 164 also receive smaller diameter AWG 24 wire. AWG 22 and AWG 24 wires are accurately located in rear passage portion 140 to position the conductors in the wires for engagement with pierce points on a member 18 when the assembly is closed.

A longitudinal contact member or pierce point slot 166 extends from the bottom of wire carrier body 138 up to each wire passage 140. The slots 166 run from the front of the body to the end of each contact member 18 and are located above slots 56 in base 12. Slots 56 and 166 have a width approximately equal to the 0.4 mm, thickness of contact strip 84. Lead-in bevels 168 are provided at the lower ends of slots 166. See FIGS. 7 and 9. Beveled lead-ins 170 extend around the inlet ends of wire passages 140.

Indicia 172 formed on the top of bodies 138 indicate the diameters of wires which can be inserted into passages 140. In the assembly shown in FIG. 3, the passages can receive AWG 22 or AWG 24 wires. AWG 22 wires are shown inserted in the passages in FIGS. 4, 5, and 7-11.

FIG. 14 illustrates an alternative wire carrier 174. Carrier 174 is like carrier 14 but receives smaller diameter AWG 26 wires having an outer diameter of 1.0 mm and a conductor diameter of 0.42 mm. The wire passages 176 in carrier 174 are cylindrical in cross-section and have a diameter to receive AWG 26 wire. Slots 177 extend from passages 176 to the bottom of the carrier. Indicia 178 on the top of the side of carrier 174 indicate the carrier receives AWG 26 wire. Wire carrier 174 is otherwise like carrier 14.

The front end of each carrier 14 or 174 includes a recessed step 180 and a forwardly angled wall 182 extending up from the step to the top of the carrier. The step and wall form an acute angle recess 184 at the top of the front of the carrier. A tool, such as a screwdriver tip, may be positioned in recess 184 to push the carrier from the elevated wire insertion position shown in FIG. 7 down to the closed contact position shown in FIG. 8. A tool in the recess can steady the carrier during printing or affixing of indicia 172 on the top of the carrier. Latch surface 186 is located on the front end of body 138 above and between wire passages 140. The surface is recessed a slight distance below step 180.

After the contact members 18 are inserted into base 12, each wire carrier is inverted to position contact slots 166 on the top of the carrier and the carrier is positioned behind the base with rotation posts 148 behind a pair of slots 48 in a pair of extensions 38 and 42 or 40 and 42. The base and carrier are then moved together to snap the rotation posts 148 past narrow mouths 48 and into retention slots 46. The posts 148 have limited forward and backward movement in the slots.

Figure 4:
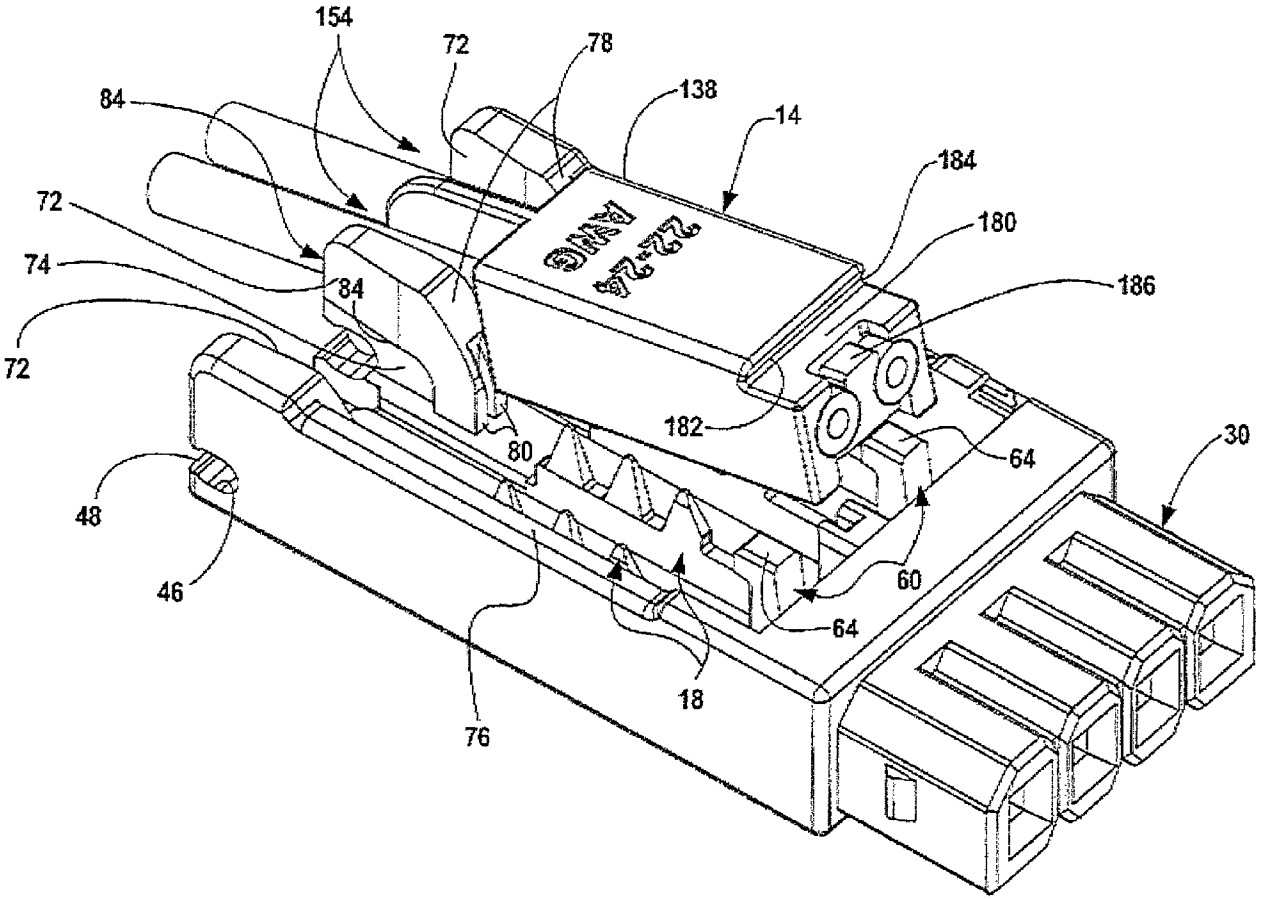
FIG. 4 is a view like FIG. 1 showing one wire carrier in the open position and the other wire carrier removed.
Figure 5:
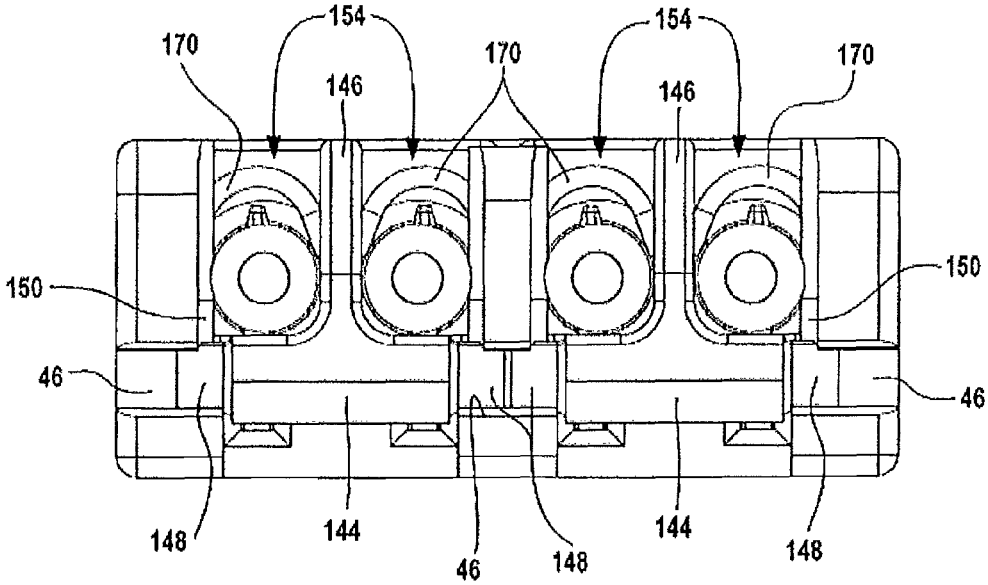
FIG. 5 is a rear view of the assembly shown in FIG. 1 with large diameter wires in the assembly.
Figure 6:
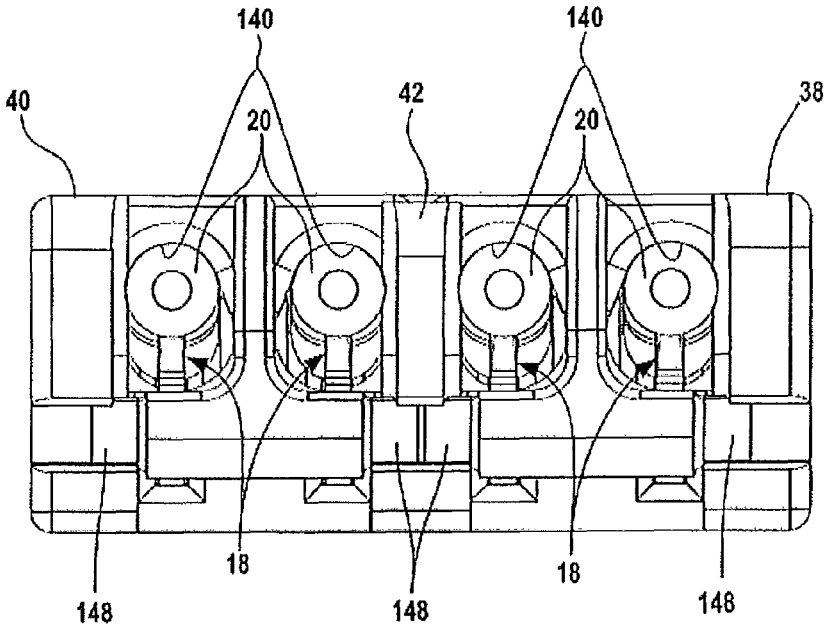
FIG. 6 is a rear view like FIG. 5 with smaller diameter wires in the assembly.

Next, the wire carrier is rotated about posts 148 to the wire insertion position shown in FIGS. 4 and 7. During rotation of the wire carrier, the opposed sides of support member 146 move along tapered sides 72 on the adjacent extensions to locate the carrier laterally so that the contact or pierce point slots 166 are located in alignment above slots 56 in the base and the metal contact members 18 in slots 56. As shown in FIG. 7, the tips of the pierce points extend a short distance into the slots 166 but do not extend into the wire passages 140. Bevels 184 at the bottom edges of contact slots 166 assure alignment between the slots and the pierce points.

During rotation of the wire carrier 14 to the wire insertion position of FIG. 7 the rotation limiting posts 150 are moved downwardly along the interior sides 72 of the adjacent extensions. The spacing between the ends of the rotation limiting posts 150 is slightly greater than the spacing between the adjacent sides of the extensions above cavity recesses 74. The posts 150 are rotated down past sides 72 and snap under the walls into the recesses 74 to prevent upward rotation of the wire carrier above the wire inserted position shown in FIGS. 4 and 7.

Also, during rotation of each wire carrier to the wire insertion position, the support member rear wall 144 is moved along cam surfaces 78 on the extensions to position the front end of the body 138 on a latch 60 as illustrated in FIG. 4.

The wire carrier is held in the elevated, wire insertion position in FIG. 4 against upward and downward rotation. Latch 60 prevents free downward rotation of the wire carrier. Posts 150, which are located between posts 148 and the front of the wire carrier, prevent upward rotation of the wire carrier. The location of the posts 150 behind body 138 reduces the angle at which the carrier extends up from the base to make it easier to rotate the carrier from the wire insertion position down to the contact position in the base.

With the wire carrier in the wire insertion position, insulated AWG 22 or AWG 24 wires are inserted into the wire carrier passages 156 from the rear of the assembly. The lead ends of the wires are positioned in wire alignment spaces 154 and are pushed forwardly into the wire passages. The beveled lead-ins 170 at the rear ends of the passages guide the wires into the passages. AWG 22 wires fit in lower wire passage portions 158. Smaller diameter AWG 24 wires extend loosely in the passages. During movement of the wire carriers to the contact position, small diameter AWG 24 wires are moved up into upper passage portions 160 and are held in these portions to locate the wires and the conductors in the wires in position to be pierced by points 96, 98 and 100.

The wires are fed through the passages a suitable distance as required by the wiring environment. Any lead portions of the wires extending forwardly from the wire carriers 14 are trimmed away at the front of the carrier. The wires are positioned in the passages as shown in FIG. 7.

Insulation displacement electrical connections are formed between the conductors in the wires and the pierce points of contact members 18 by rotating the wire carriers down into the base from the elevated wire insertion position of FIG. 7 to the lower contact position of FIG. 8. Considerable force may be required in order to rotate the carrier into the base and pierce the wires. This force may be applied by positioning the open assembly of FIG. 7 between two flat surfaces of a press tool. The surfaces are moved together to engage the top of the wire carrier and the bottom of the base and rotate the carrier downwardly into the base.

Alternatively, the base may be positioned on a support surface and a tool may be fitted into a transverse groove formed in the top of the wire carrier (not shown) or recess 184 to apply a downward force on the carrier and rotate the carrier down into the base.

When a press is used to rotate the wire carriers into the base, the closing surface which engages the carriers is moved downwardly to rotate the carriers into the base until the surface of the press engages the tops of side wall recesses 76. The recesses prevent over rotation of the carriers and resultant injury to the assembly.

When the wire carrier 14 is rotated to the closed contact position, the carrier moves along cam surfaces 78 and is moved against latch 60. Posts 148 move forward in slots 46. The latch 60 is flexed forwardly and, when the carrier has been fully rotated into recess 44 and step 180 is below the underside of latch member 64, the latch returns to its original position with member 64 over the step to retain the wire carrier in the closed contact position between support surfaces 80 and latch member 64 to maintain insulation displacement connections between the pierce points and the wires in the carrier. Surface 186 is recessed below the top of body 138 equal to the height of member 64 so that the latch does not project above the top of the carrier. The latch does not increase the height of the assembly.

During closing of the assembly, the alignment sides 110 and 118 of points 98 and 100 slide along the walls of slot 166 to locate the tips 114 and 122 on the points a distance from the slot walls in position to pierce the conductor in the wire in the carrier. The lateral spacing between tips 114 and 122 is less than the diameter of the conductors 22 in wires 20 in passages 140. In order to form insulation displacement electrical connections with AWG 22 and AWG 24 wires, the tips 122, 114, 106 individually, must be spaced closer together than 0.51 mm, the diameter of the conductor in the smaller AWG 24 wire. In order to form electrical connections with conductors in still smaller AWG 26 wire, the tips must be spaced apart a distance less than 0.40 mm, the diameter of the conductor in AWG 26 wire. A single metal contact member 18, with pierce point tips 114 and 122 laterally spaced apart a distance less than 0.40 mm may be used for forming electrical connections with conductors in AWG 22, AWG 24 and AWG 26 wires.

Double tapered pierce point 96 is moved up against the center of the wire and penetrates the center of the conductor to form a third insulation displacement electrical connection between the member 18 and the conductor.

During penetration of larger diameter AWG 22 wire, as shown in FIG. 7, the wire is retained at the enlarged bottom of the wire passage and is pushed up against the chordal walls 162 of the passage between portions 158 and 160. During penetration of the small diameter AWG 24 wire, the wire is pushed up to passage portion 160 and the pierce points extend through the wire. In both cases, the wires are accurately positioned above the three pierce points 96, 98 and 100 and the points pierce the conductors to make three insulation displacement electrical connections.

After a wire carrier has been rotated down into the base to form electrical connections between wires in the carrier and the metal contact members, the forward facing stop edges 132 of the forward pierce points 100 extend through the insulation of the wires confined in each wire passage to prevent pull out of the wires in the event the tensile force is exerted on the portions of the wires extending rearwardly from the assembly.

During rotation of the wire carrier into the base to establish electrical connections with wires in the carrier, the tips 114 and 122 of pierce points 98 and 100 are maintained in proper position relative to the wire by sliding engagement of the pierce point alignment sides 110 and 118 along the opposite parallel walls of slot 166. The contact member 18 has a thickness equal to the width of slot 166 so that the alignment sides are guided along the walls of the slot as they penetrate the wire and the tips make electrical connections with the central conductor. This sliding engagement between the pierce points and the walls of the slot 166 positions the tips slightly inwardly from the walls of the slot to assure that they engage and penetrate the central conductor. The wire, whether AWG 22 or AWG 24, if the wire is positioned in wire carrier 14 or AWG 26, if the wire is positioned in carrier 174, is located above the slot with the conductor held in position above the aligned pierce points.

Alignment of the pierce points 98 and 100 in assembly 10 is maintained by complementary sliding alignment engagement between the flat parallel slot side walls and the flat alignment sides of the pierce points. The carrier is rotated into the base.

A number of types of sliding engagement between the walls of the pierce point slot and the alignment sides of the pierce points may be used to align the tips during movement of the carrier into the base. For instance, complementary sliding alignment engagement between the alignment side of a pierce point and one slot walls in the wire carrier may be established by two flat, parallel surfaces sliding along each other, as described above.

Complementary sliding alignment engagement between the pierce points and the slot wall may also be established by engagement between one flat surface on one of A) a slot wall or pierce point or B) a geometric point or line on the other of the slot wall or point.

Additionally, complementary sliding alignment engagement between the pierce point and side wall may be established by two lines sliding along each other or by one line and a geometric point sliding along each other. The two lines may be straight or may be curved, so long as the engagement maintains the lateral position of the tips on the pierce points during movement of the wire carrier to the contact position.

As used herein, "complementary sliding alignment engagement" between the pierce points and the wire carrier side walls includes all relationships which assure aligned movement of the pierce point tips into the wire to engage the central conductor and establish insulation displacement electrical connections.

In the first embodiment disclosed in FIGS. 1-20, electrical connector assembly 10 includes a base 12 and two, two-wire carriers 14 mounted in the base. The invention is not limited to an assembly with two wire carriers. If desired, the assembly may have a single wire carrier or three or more wire carriers laterally spaced across a wider base adapted to receive more than two wire carriers. Additionally, the wire carriers may have one or three or more wire passages and receive one, three or more wires with an appropriate number of contact members in the base.

In the first embodiment, the wire carriers in electrical connector assembly 10 are rotated down into the base to establish insulation displacement connections with the pierce points extending upwardly from the contact members mounted in the base.

FIGS. 21-28 illustrate a second embodiment electrical connector assembly 200 related to assembly 10 having a molded dielectric base 202 and molded dielectric wire carrier 204. The wire carrier 204 is pushed straight down into or translated into the base to establish insulation displacement electrical connections. Assembly 200 uses components identical to components of assembly 10. Reference numbers describing components of assembly 10 which are used in assembly 200 are identified using the previously introduced reference numbers.

Base 202 is similar to base 12 and includes bottom wall 28, slots 56 in the bottom wall, side walls 34 and 36 and contact housing 30 extending across the front end of the base. Metal contact members 18 are fitted in slots 56 with contact elements 90 in housing contact chambers 50.

Wire carrier 204 includes a rectangular molded plastic body 206 with four spaced wire passages 140 extending from the rear to the front of the body. Cylindrical wire passages, like wire passages 176 in carrier 174, may be used if desired. Contact or pierce point slots 166 extend from passages 140 to the bottom of the carrier.

Vertical alignment slots 208 are provided on the interior surfaces of side walls 34 and 36. Complementary vertical alignment projections or ribs 210 extend outwardly from the opposite sides of body 206 and are fitted in slots 208. The projections 210 have a close sliding fit in slots 208 and prevent movement of the wire carrier in the base 202 toward or away from housing 30. Slots 208 extend from the base bottom wall 28 to the top of the side walls to permit movement of the wire assembly 204 from an elevated wire insertion position shown in FIGS. 21, 22, 23, 25 and 26 to a contact position with the wire carrier seated in the base shown in FIGS. 24, 27 and 28.

The wire carrier 204 has a close sliding fit between the interior sides of walls 34 and 36 so that the pierce points on contact members 18 are in alignment with pierce point slots 166 and movement of the wire carrier from the wire insertion position into the base to the contact position moves the pierce points into conductors in wires 20 inserted into passages 176 for establishment of electrical connections between the contacts and the conductors in the wires, as previously described.

Figure 21:
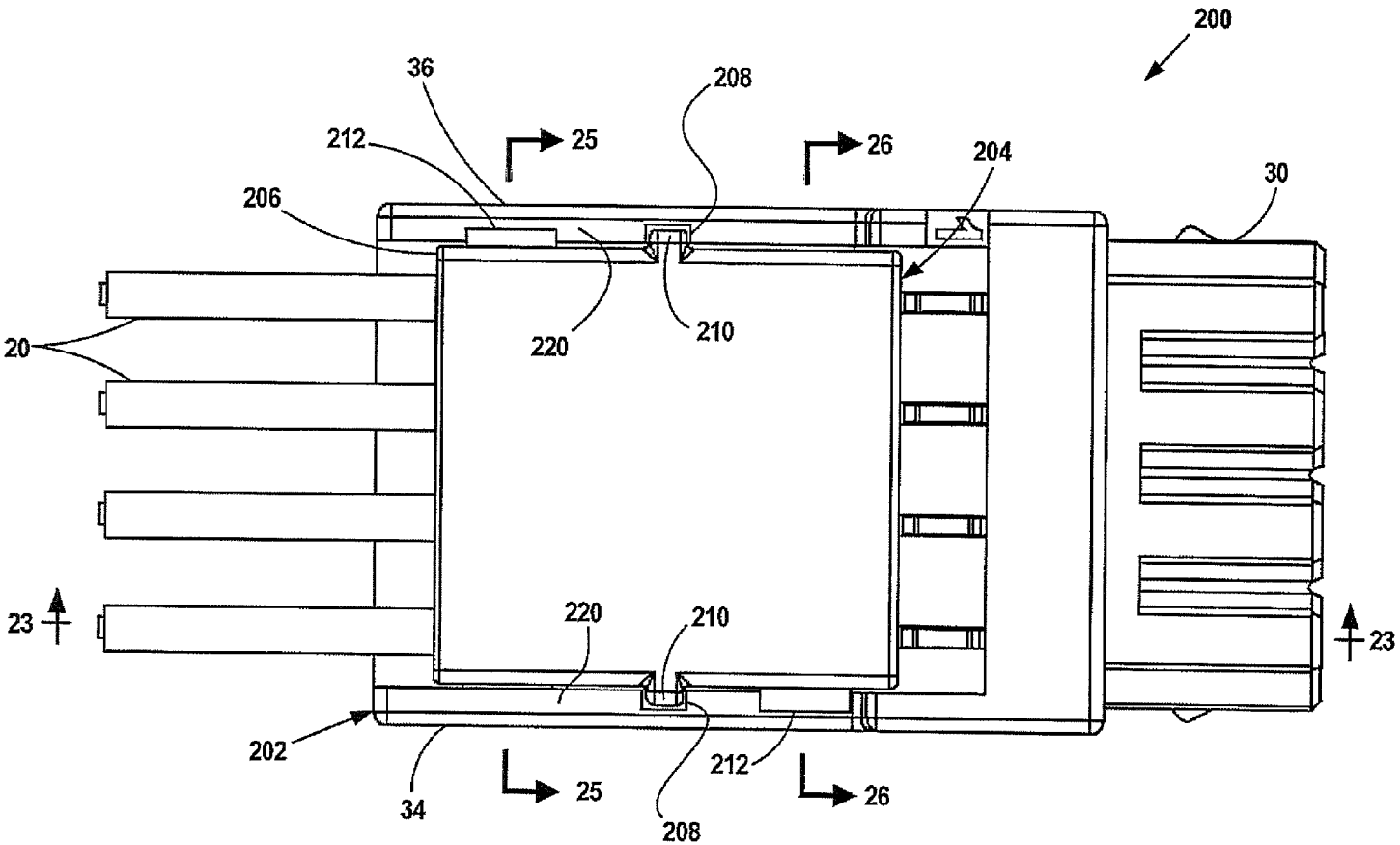
FIG. 21 is a top view of a second embodiment electrical connector assembly.
Figure 22:
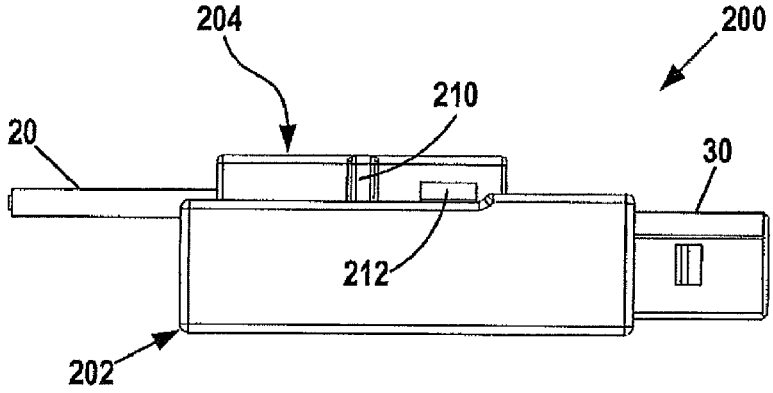
FIG. 22 is a side view of the assembly of FIG. 21 prior to forming electrical connections between wires and contact members.
Figure 23:
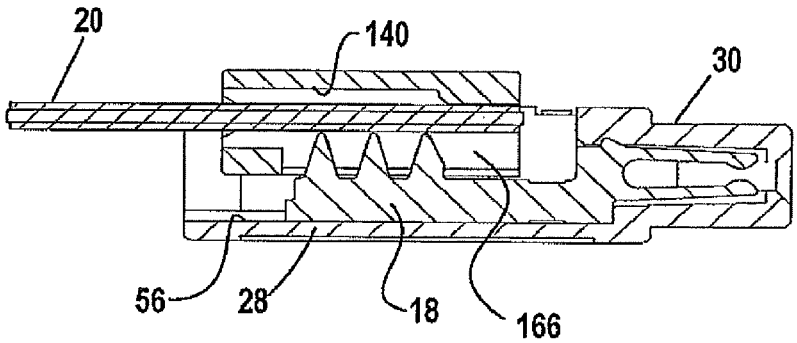
FIG. 23 is a vertical sectional view along line 23-23 of FIG. 21.
Figure 24:
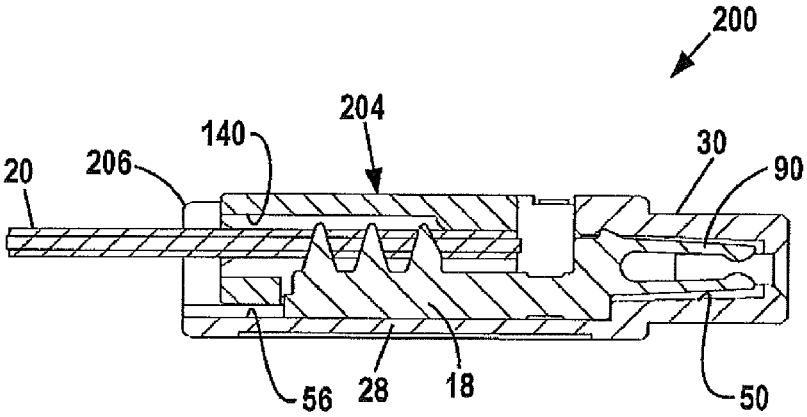
FIG. 24 is a vertical sectional view through the assembly like FIG. 23, after closing of the assembly and establishment of electrical connections.
Figure 26:
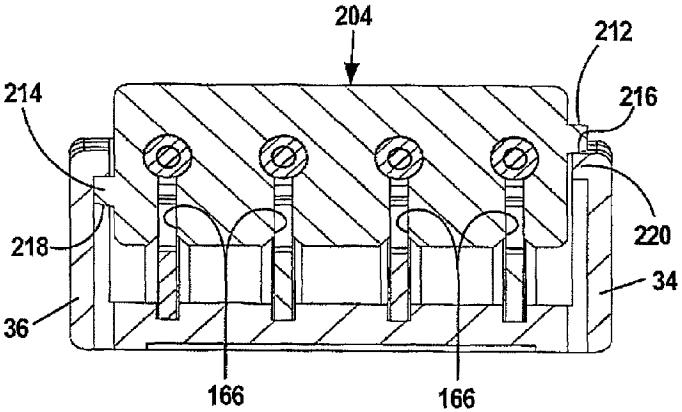
FIGS. 25 and 26 are vertical sectional views taken through the assembly at lines 25-25 and 26-26.

Wire carrier 204 includes two diagonally spaced upper latch stops 212 shown in FIG. 21 and two diagonally spaced lower latch stops 214. Stops 212 are located on the sides of the carrier adjacent base walls 34, 36 at the upper left and lower right corners of the carrier as shown in FIG. 21. Lower latch stops 214 are located on the sides of the carrier adjacent the opposite corners at a level below stops 212. The lower surfaces 216 of stops 212 are tapered. The lower surfaces 218 of stops 214 are likewise tapered.

Latches 220 extend inwardly from the tops of side walls 36 and 38 along the wire carrier and past the upper and lower latch stops 212 and 214. The side walls of base 202 are somewhat flexible, permitting elastic outward displacement during movement of the upper and lower stops 212, 214 past latches 220 and return.

Wire carrier 204 is mounted on base 202 in the upper wire-insertion position by positioning the carrier on the top of the base with alignment members or ribs 210 in alignment slots 208 and then pushing the carrier down into the base. The two diagonal lower latch stops 214 engage the latches 220, flex the sides of the base outwardly and move past the latches to the elevated wire insertion position shown in FIG. 25. The walls 34, 36 flex back to locate the latches 220 above the lower stops 214 and below the upper stops 212. The wire assembly is held in place on the base in the wire-insertion position by stops 212 and 214.

Figure 28:
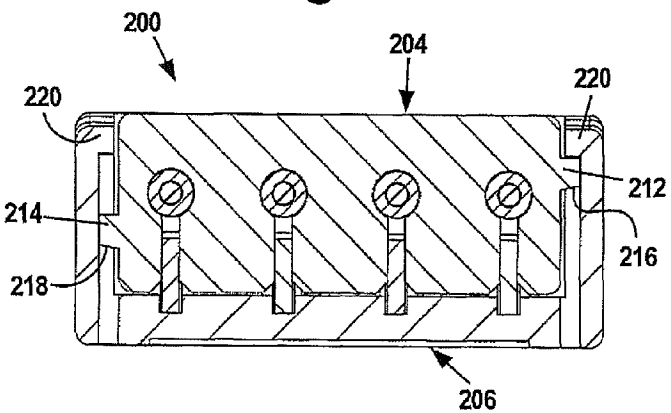
FIGS. 27 and 28 are sectional views like FIGS. 25 and 26 after closing of the assembly and establishment of electrical connections.
Figure 25:
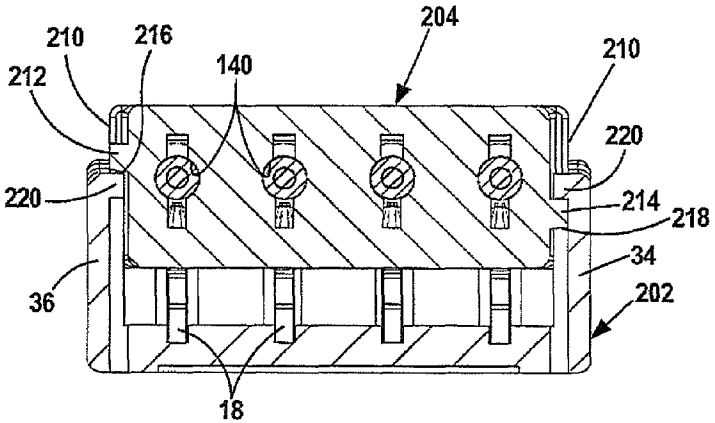
Figure 27:
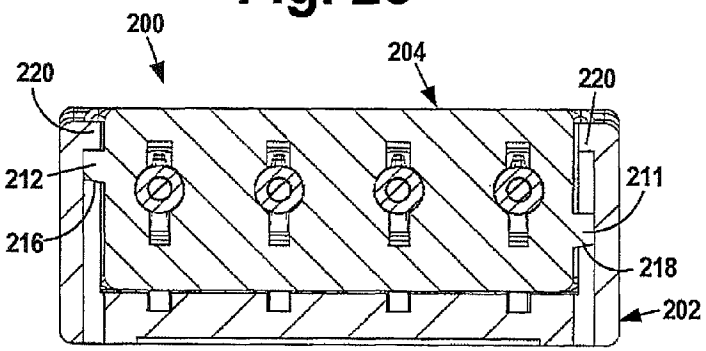

After insertion of wires into wire passages 140, the wire carrier is pushed into the base so that the upper latch stops 212 flex walls 34, 36 outwardly and move past latches 220 to lower contact position as shown in FIGS. 27 and 28. In this position, the upper latch stops are located below latches 220 and hold the wire carrier in place in base 202.

During movement of the wire carrier into the base, the pierce points on the contact members extend into the wires in the wire passages and form insulation displacement electrical connections with the conductors in the wires, as previously described.

If desired, indicia may be provided on the top of the wire carrier identifying the AWG sizes of wires which can be inserted into passages in the carrier.

Both the first embodiment electrical connector assembly 10 and the second embodiment electrical connector assembly 200 form reliable insulation displacement electrical connections between small diameter wires inserted into the assembly and contact posts or blades inserted into contact chambers 50 to engage contact elements 90.

The wire carriers use an electrical connector assemblies and 200 are rotated or translated into their respective bases to form electrical connections with two contact members. The use of wire carriers each of which receive two wires reduces the force needed to move each carrier into the base to extend the pierce points into electrical connection with conductors in wires inserted into the wire passages. Wire carriers with two wires can be manually pushed from the elevated wire insertion position to the contact position. Use of this type of wire carrier eliminates the need to provide a specialized tool for forming electrical connections in the field. They are simply manually pushed into the base. If desired, wire carriers may be provided for one or three or more wires. Wire carriers receiving three or more wires are typically moved to the contact position using a tool.

Electrical connector assemblies 10 and 200 are small and have very close centerline spacing between the contact members and the wires in the wire passages. Reduction in the size of the assemblies reduces manufacturing cost and reduces the amount of space required for mounting the assemblies on circuit boards or other circuit members.

The electrical connector assemblies 10 and 200 each include a base and two identical wire carriers. The use of identical wire carriers reduces the cost of manufacture. The specialized wire passages permit positioning of wires of different diameters in the passages and forming reliable insulation displacement connections with small wires positioned in the passages. The passages assure that the conductors in the wires are located above the pierce points during closing so that the pierce points engage the conductors and form electrical connections with the conductors. The triangular shape of the pierce points and the tapered thickness of the pierce points provide normal forces between the pierce points and the conductors in the wires to enhance the electrical connections.

The tips on the three wire pierce points are laterally spaced across the width of the contacts to increase the likelihood that the pierce points hit and extend through the conductor in a wire inserted in the wire passage. Normally, the shape of the wire passages assures that the conductor in the wire in the passage is located above the tips and all three tips hit the conductor.

The invention claimed is:

1. An electrical connector assembly comprising a wire carrier, the wire carrier having a surface; a wire passage in the wire carrier; a pierce point slot in the wire carrier, the pierce point slot having opposed parallel walls each extending from the wire passage to the surface; and a metal contact member, the contact member having a contact element, and first and second pierce points, said pierce points spaced along and movable into the pierce point slot, each pierce point having a small tip at the top of the pierce point, an alignment surface on one side of the pierce point and a tapered surface on the other side of the pierce point; the alignment surface of the first pierce point slidably engaging one slot wall, the alignment surface of the second pierce point slidably engaging the other slot wall; wherein upon positioning a wire in the wire passage and moving the pierce points into the slot, the pierce point tips penetrate the wire to form laterally spaced insulation displacement electrical connections with a conductor in the wire.

2. The electrical connector assembly as in claim 1 wherein the wire passage and slot are straight.

3. The electrical connector assembly as in claim 2 wherein the contact member includes a strip and the pierce points extend away from the strip.

4. The electrical connector assembly as in claim 3 wherein the contact member includes a third pierce point movable into the pierce point slot.

5. The electrical connector assembly as in claim 3 wherein the strip has opposed, parallel sides, the alignment surface of the first pierce point forming an extension of one strip side and the alignment surface of the second pierce point forming an extension of the other strip side.

6. The electrical connector assembly as in claim 5 including a base, a base slot in the base, and wherein the strip is positioned in the base slot.

7. The electrical connector assembly as in claim 6 including a hinge between the carrier and the base.

8. The electrical connector assembly as in claim 6 including a latch connection between the carrier and the base.

9. The electrical connector assembly as in claim 6 including a linear sliding connection between the base and the wire carrier.

10. An electrical connector assembly comprising a wire carrier, the wire carrier having a surface; a wire passage in the wire carrier; a pierce point slot in the wire carrier, the slot having opposed parallel walls each extending from the wire passage to the surface; a metal contact member having a contact element and a first pierce point, said pierce point extending into the pierce point slot, the pierce point having a small first tip at the top of the pierce point, an alignment surface on one side of the pierce point, the tip adjacent the alignment surface, said alignment surface slidable engaging one slot wall, and a tapered surface on the other side of the pierce point, the tapered surface extending to the tip; wherein upon positioning an insulated wire in the wire passage and moving the pierce point into the slot, the alignment surface slides along the one slot wall and the pierce point tip penetrates the wire to form an insulation displacement electrical connection with a conductor in the wire.

11. The electrical connector assembly as in claim 10 including a base, the contact member mounted in the base with the pierce point extending outwardly from the base for movement into the slot in the wire carrier.

12. The electrical connector assembly as in claim 11 including a hinge connection between the wire carrier and the base.

13. The electrical connector assembly as in claim 11 including a latch for holding the base and wire carrier together.

14. The electrical connector assembly as in claim 10 including a linear sliding connection between the base and the wire carrier.

15. The electrical connector assembly as in claim 10 wherein the contact member includes a second pierce point, said second pierce point including a second tip at the top of the second pierce point and adjacent said other slot wall.

16. The electrical connector assembly as in claim 15 wherein said metal contact member includes a third pierce point, said third pierce point having a third tip located between said first and second tips.

17. The electrical connector assembly as in claim 10 wherein said wire passage and said slot are straight.

18. The electrical connector assembly as in claim 10 wherein the pierce point includes a short tapered surface between the tip and the alignment surface.

19. The electrical connector assembly as in claim 10 wherein the wire passage is circular in cross section.

20. The electrical connector assembly as in claim 10 wherein the wire passage is centered above the slot so that the tip penetrates one side of the wire and forms an off center electrical connection.

* * * * *

UNITED STATES PATENT AND TRADEMARK OFFICE

CERTIFICATE OF CORRECTION

PATENT NO. : 7,942,689 B1
APPLICATION NO. : 12/957500
DATED : May 17, 2011
INVENTOR(S) : Huss, Jr. et al.

It is certified that error appears in the above-identified patent and that said Letters Patent is hereby corrected as shown below:

Column 12, Line 37, replace “slidable” with --slidably--.

Signed and Sealed this
Twenty-eighth Day of June, 2011

David J. Kappos

David J. Kappos
*Director of the United States Patent and Trademark Office*